US006298925B1

(12) United States Patent
Lee et al.

(10) Patent No.: US 6,298,925 B1
(45) Date of Patent: Oct. 9, 2001

(54) METHOD AND APPARATUS FOR INSTALLING A SMALL-SCALE GROUNDWATER SAMPLING WELL

(75) Inventors: Landris T. Lee; Stafford S Cooper; Philip G. Malone, all of Vicksburg, MS (US)

(73) Assignee: The United States Army Corps of Engineers as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/564,030

(22) Filed: May 4, 2000

(51) Int. Cl.[7] ..... E21B 7/20

(52) U.S. Cl. ..... 175/20; 175/19; 175/22; 166/264

(58) Field of Search ..... 175/19, 20, 22, 175/23, 59, 60, 40; 166/264, 381

(56) References Cited

U.S. PATENT DOCUMENTS

| | | | | |
|---|---|---|---|---|
| 2,512,226 | | 6/1950 | Edwards . | |
| 4,807,707 | * | 2/1989 | Handley et al. | 175/20 |
| 5,146,998 | | 9/1992 | Cordry et al. . | |
| 5,402,848 | * | 4/1995 | Kelly | 166/266 |
| 5,474,140 | * | 12/1995 | Stevens | 175/20 |
| 5,487,431 | * | 1/1996 | Webb | 175/20 |
| 5,542,472 | | 8/1996 | Pringle et al. . | |
| 5,612,498 | | 3/1997 | Wittig et al. . | |
| 5,669,454 | * | 9/1997 | Cordry | 175/20 |
| 5,921,328 | * | 7/1999 | Babineau et al. | 175/20 |
| 6,116,353 | * | 9/2000 | Leavell et al. | 175/20 |

FOREIGN PATENT DOCUMENTS

| | | | | |
|---|---|---|---|---|
| 645448 | * | 1/1936 | (DE) | 175/20 |
| 2218441A | * | 11/1989 | (GB) | 175/20 |

* cited by examiner

*Primary Examiner*—Frank Tsay
(74) *Attorney, Agent, or Firm*—Earl H. Baugher Jr.

(57) ABSTRACT

A method and apparatus for installing a groundwater sampling device into the ground includes a generally cylindrical housing open at top and bottom end portions and defining a recess therein. An expendable tip member is removably connected to the bottom and portion of the housing. A well tubing or casing is positioned generally centrally in the recess and includes top and bottom end portions. An elongated spiral-wound cylinder is slidably positioned in the recess of the housing and in a surrounding relationship to the tubing. The tubing is attached to the tip member at the bottom end portion thereof and includes a lower section having a plurality of perforations about the periphery thereof to allow fluid to enter the interior of the tubing.

15 Claims, 1 Drawing Sheet

METHOD AND APPARATUS FOR INSTALLING A SMALL-SCALE GROUNDWATER SAMPLING WELL

FIELD AND HISTORICAL BACKGROUND OF THE INVENTION

The present invention is directed to a groundwater sampling device, and more particularly to a method and apparatus for installing a small-scale groundwater sampling well.

Presently, only single groundwater samples can be collected with a penetrometer unit. The installation of even a shallow (15 feet deep) monitoring well generally requires the use of a drill rig and necessitates eight or more hours of work by a crew of two technicians. In this regard, various groundwater sampling devices are currently available in the art as illustrated in U.S. Pat. Nos. 2,512,226; 5,146,998; 5,542,472; and 5,612,498.

In particular, U.S. Pat. No. 2,512,226 to Edwards discloses electrical heating of oil wells by applying electrically generated heat to a casing structure at the bottom of the well, to the oil-producing geological formation, and, if desired, to the oil flow lines leading from the oil-producing formation to the top of the well.

U.S. Pat. No. 5,146,998 to Cordry et al. discloses an apparatus and method for underground sampling wherein the system includes a hollow body for containing the underground device and a drive cone adapted to penetrate the ground.

U.S. Pat. No. 5,542,472 to Pringle et al. discloses a metal coiled tubing with a signal transmitting passageway for transmitting and/or receiving signals to well tools positioned in the coiled tubing.

U.S. Pat. No. 5,612,498 to Wittig et al. discloses a groundwater sampling device which includes an elongated cylindrical integral hollow housing with an inner surface defining an inner bore. An elongated hollow screen is telescopically received within the housing and is capable of being placed in a stowed position completely within the housing during driving of the device into the ground, and in a deployed position where it extends out of the lower end of the housing to collect groundwater.

The prior art devices are, however, complicated and not fully satisfactory. Therefore, there is a need in the industry for a small-scale groundwater sampling well which can be installed easily with a minimum amount of labor.

OBJECTS AND SUMMARY OF THE INVENTION

The principal object of the present invention is to provide a method and apparatus for installing a small-scale groundwater sampling device which overcomes the disadvantages associated with the conventional devices and techniques and is easy to construct and inexpensive to manufacture.

Another object of the present invention is to provide a method and apparatus for installing a small-scale groundwater sampling device which can be used by the conventional push-in equipment associated with a civil engineering cone penetrometer.

Yet another object of the present invention is to provide a method and apparatus for installing a small-scale groundwater sampling device which allows the conventional penetrometer to install a well that can be used for continuous monitoring of groundwater quality using two penetrometer operators with only one or two hours of work.

Still yet another object of the present invention is to provide a method and apparatus for installing a small-scale groundwater sampling device which installs a well using the same design that the U.S. EPA requires for a full-scale monitoring well.

An additional object of the present invention is to provide a method and apparatus for installing a small-scale groundwater sampling device wherein the well will operate with the dependability equal to that of a full-scale well. Yet an additional object of the present invention is to provide a method and apparatus for installing a small-scale groundwater sampling well wherein the well can conveniently have monitoring devices incorporated into the tip of the casing or tubing provided for sampling.

Still yet an additional object of the present invention is to provide a method and apparatus for installing a small-scale groundwater sampling well wherein the installation of the well is done by pushing and not drilling. Therefore, the operation does not generate any well cuttings, that is any soil removed in excavating a hole for the well casing. This is advantageous in that the well cuttings typically have to be tested prior to disposal to determine if the soil is contaminated. Disposal of contaminated cuttings adds extra cost to any well drilling operation, A further object of the present invention is to provide a method and apparatus for installing a small-scale groundwater sampling well wherein penetrometers can be used to produce permanent water sampling points, e. g. groundwater monitoring wells.

Yet a further object of the present invention is to provide a method and apparatus for installing a small-scale groundwater sampling well wherein the monitoring wells produced are equivalent in construction to the monitoring wells that would normally be installed on a larger scale with a drill rig.

Still yet a further object of the present invention is to provide a method and apparatus for installing a small-scale groundwater sampling well wherein the amount of time required to install a conventional groundwater monitoring well with a drilled rig is reduced to 1–2 hours of work.

Still yet a further object of the present invention is to provide a method and apparatus for installing a small-scale groundwater sampling well wherein instrumentation needed to measure the water temperature or electrical conductivity can be provided in the well tip and monitored through a hard wire connection to the surface.

Still yet a further object of the present invention is to provide a method and apparatus for installing a small-scale groundwater sampling well wherein granular materials needed to form a filter layer, and to form a seal, can be dispensed without jamming the installation apparatus.

In accordance with the present invention, an apparatus for installing a groundwater sampling device into the ground includes a generally cylindrical housing open at top and bottom end portions and defining a recess therein. An expendable tip member is removably connected to the bottom end portion of the housing. A well tubing or casing is positioned generally centrally in the recess and includes top and bottom end portions. An elongated spiral-wound cylinder is slidably positioned in the recess of the housing and in a surrounding relationship to the tubing. The tubing is attached to the tip member at the bottom end portion thereof and includes a lower section having a plurality of perforations about the periphery thereof to allow fluid to enter the interior of the tubing.

BRIEF DESCRIPTION OF THE DRAWINGS

The above and other objects and novel features of the present invention will become apparent from the following detailed description of the invention as illustrated in the accompanying drawings, in which.

DETAILED DESCRIPTION OF THE INVENTION

Figure 1:
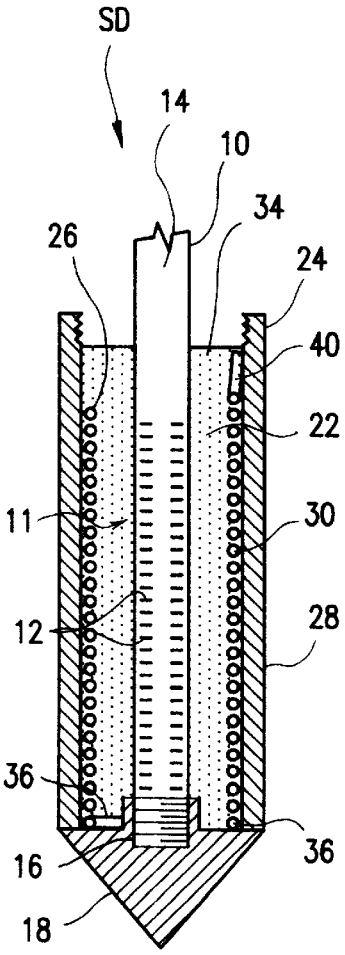
FIG. 1 is a vertical sectional view of the apparatus of the invention.

The sampling device SD of the present invention allows a small diameter well tubing to be put in place with a granular filter material and with a clay sealing layer on top (not shown) at a selected point below the ground surface using the pushing capabilities associated with a civil engineering cone penetrometer apparatus.

The well installation apparatus of the invention includes a tube 10, that acts as a well and is equipped at its lower screen section 11 with perforations, holes or slots 12, that will allow water to enter the center 14 of the tubing. The tubing 10 is attached at its bottom end portion 16 to an expendable metal penetrometer cone tip 18. The tip 18 closes the bottom end 16 of the 10 tubing and provides a soil anchor that holds the end 16 of the tubing 10 firmly in the soil.

The tubing 10 passes up the inside recess or interior 22 of the hollow core penetrometer rod 24 to the ground surface. A cylinder 26, formed from a coil of wire or extruded plastic (mono-filament nylon) line, that is only slightly smaller than the interior 22 of the cone penetrometer rod 24, approximately 1 inch in outer diameter, encircles the casing tubing 10 and fits inside the lower section 28 of the cone penetrometer rod 24. The lower portion 30 of the cylinder 26, that surrounds the lower screen section 11 of the tubing 10, is filled with an inert granular material 34, for example, quartz sand, glass beads, etc., of such size as to act as a filter for the water entering the lower screen section 11.

The cylinder 26 is of a length sufficient to carry all of the sand that is necessary to fill the space between the tubing 10 and the soil S that is outside of the penetrometer rod 24 to a point above the top of the slots 12 in the tubing 10. The bottom end portion 36 of the cylinder 26 is attached to the bottom end 16 of the tubing 10 and the expendable conical tip 18. The top 40 of the wire cylinder 26 is allowed to pass up the hollow interior 22 of the rod 24 alongside the tubing 10 to the ground surface.

Figure 2:
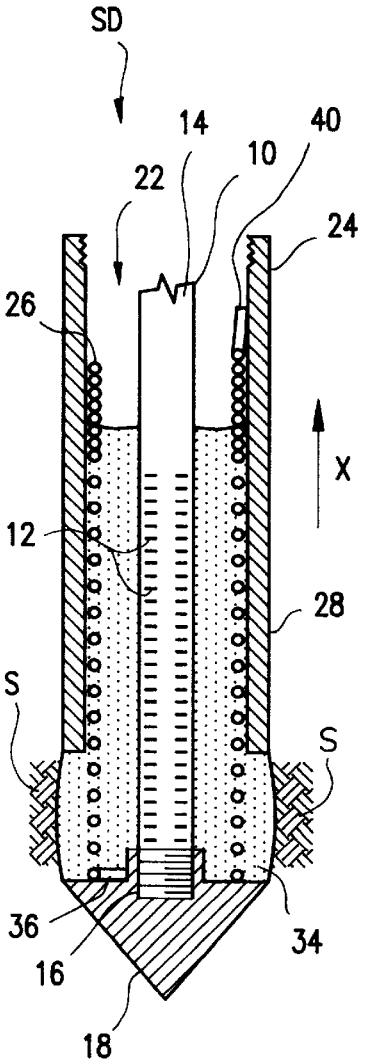
FIG. 2 is a view similar to FIG. 1, showing retraction or withdrawal of the penetrometer rod upwardly.
Figure 3:
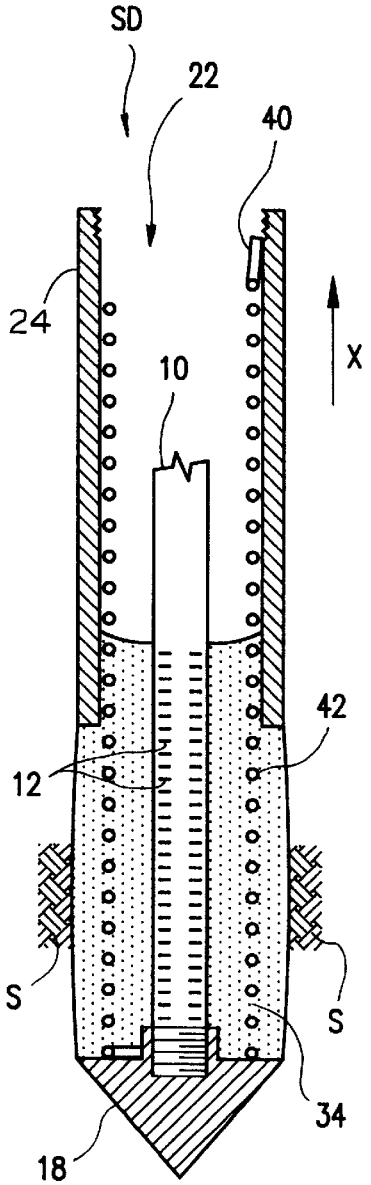
FIG. 3 is a view similar to FIG. 2, showing the penetrometer rod being further retracted to allow the spiral-wound wire cylinder to uncoil or spread to release the granular filter material.

In operation, the cone penetrometer rod 24 is forced into the soil S to the point where a groundwater sample is to be obtained, and the rod 24 is then pulled back up toward the surface (see arrow X in FIGS. 2–3). As the rod 24 is lifted, the expendable tip 18 remains in the soil S and the wire cylinder 26 is opened by pulling the uphole wire to spread the wires in the cylinder to form a circular coil 42 and move the wire inwardly toward the tubing 10. Uncoiling the wire cylinder 26 releases the granular material 34 contained therein. The granular filter material 34 fills the space between the soil and the well tubing 10. Preferably, a granular bentonite (clay layer not shown) is distributed across the top of the filter material (sand), and sufficient water is pumped down the center of the penetrometer rod 24 to hydrate the granular bentonite and form a watertight seal. A water-bentonite slurry is pumped down the center of the penetrometer rod 24 as it is withdrawn to the surface. This operation results in the placement of a well tubing 10 with the screen section 11 at a specific point in the soil S. The screen section 11 is surrounded with clean granular material (sand) and the top of the filter material is sealed with a layer of hydrated bentonite (clay). The penetrometer hole is then sealed with a hydrated bentonite slurry or grout covering its entire length. Surface water cannot infiltrate the well and contaminate the water sample and multiple water samples can be drawn from the well.

Additionally, data can be collected from any sensors that are incorporated into the expendable tip 18. The well can be completed by capping the tubing of the well to prevent any foreign material from being inadvertently introduced into the well tubing and enclosing the wellhead in some type of protective structure to prevent vandalism.

While this invention has been described as having preferred ranges, steps, materials, or designs, it is understood that it is capable of further modifications, uses and/or adaptations of the invention following in general the principle of the invention, and including such departures from the present disclosure, as those come within the known or customary practice in the art to which the invention pertains and as may be applied to the central features hereinbefore set forth, and fall within the scope of the invention and of the appended claims. It is further understood that the present invention is not limited to the claims appended hereto.

What is claimed is:

1. An apparatus for installing a groundwater sampling device into the ground, comprising:

a) a generally cylindrical housing open at top and bottom end portions and defining a recess therein;

b) an expendable tip member removably connected to the bottom end portion of said housing;

c) a well tubing positioned generally centrally in the recess and including top and bottom end portions;

d) an elongated spiral-wound cylinder slidably positioned in the recess of said housing and surrounding said tubing; and e) said tubing being attached to said tip member at the bottom end portion thereof and including a lower section having a plurality of perforations about the periphery thereof to allow fluid to enter the interior of said tubing.

2. The apparatus of claim 1, further comprising:

a) a filter material disposed within said cylinder and surrounding the lower section of said tubing.

3. The apparatus of claim 2, wherein:

a) said filter material comprises an inert granular material.

4. The apparatus of claim 3, wherein:

a) said granular material comprises quartz sand or glass beads.

5. The apparatus of claim 1, wherein:

a) said cylinder includes upper and lower end portions; and b) the lower end portion is attached to said tubing and said tip member.

6. The apparatus of claim 5, wherein:

a) the upper end portion of said cylinder extends to the ground surface.

7. The apparatus of claim 1, wherein:

a) said cylinder is formed from a wire.

8. The apparatus of claim 7, wherein:

a) said wire functions as a cable for transmitting data from said tip member.

9. The apparatus of claim 1, wherein:

a) said cylinder is formed from an extruded plastic material.

10. An apparatus for installing a groundwater sampling device into the ground, comprising:

a) an elongated cylindrical rod member having top and bottom end portions and defining a recess therein;

b) an expendable tip member removably connected to the bottom end portion of said rod member;

c) a well tubing positioned centrally in the recess and including top and bottom end portions;

d) said tubing including a screen portion having a plurality of perforations to allow fluid to enter the interior of said tubing;

e) an elongated spiral-wound cylinder positioned in the recess of said rod and surrounding said tubing;

f) said cylinder being filled with an inert filter material surrounding the screen portion of said tubing; and g) means for transmitting data from said tip member to the ground surface.

11. The apparatus of claim 10, wherein:

a) said cylinder is formed from a wire.

12. The apparatus of claim 11, wherein:

a) said data transmitting means comprises said cylinder.

13. A method of installing a groundwater sampling well using a cone penetrometer, comprising the steps of:

a) providing a cone penetrometer device including a rod with a recess, a well tubing positioned generally centrally in the recess and including a screen portion, a spiral-wound cylinder slidably positioned in the recess and surrounding the well tubing, an inert granular filter material positioned inside the cylinder and surrounding the screen portion;

b) driving the cone penetrometer into the ground to a desired location;

c) withdrawing the rod upwardly towards the ground surface;

d) leaving the tip of the penetrometer in the ground and allowing the cylinder to unwind and spread about the tubing;

e) spreading a granular sealing material over the filter material; and f) hydrating the sealing material to form a water tight seal.

14. The method of claim 13, further comprising the step of:

g) continuing to withdraw the rod upwardly and pumping a water bentonite slurry into the rod.

15. The method of claim 14, further comprising the step of:

h) capping the tubing and enclosing the well head in a protective structure.

* * * * *